US010003118B2

(12) United States Patent
Kitt

(10) Patent No.: US 10,003,118 B2
(45) Date of Patent: Jun. 19, 2018

(54) SPATIAL COUPLER AND ANTENNA FOR SPLITTING AND COMBINING ELECTROMAGNETIC SIGNALS

(71) Applicant: Qorvo US, Inc., Greensboro, NC (US)

(72) Inventor: John Kitt, Ventura, CA (US)

(73) Assignee: Qorvo US, Inc., Greensboro, NC (US)

( * ) Notice: Subject to any disclaimer, the term of this patent is extended or adjusted under 35 U.S.C. 154(b) by 67 days.

(21) Appl. No.: 15/290,749

(22) Filed: Oct. 11, 2016

(65) Prior Publication Data

US 2017/0179598 A1 Jun. 22, 2017

Related U.S. Application Data

(60) Provisional application No. 62/271,042, filed on Dec. 22, 2015.

(51) Int. Cl.

| | |
|---|---|
| ***H01P 5/12*** | (2006.01) |
| ***H01Q 9/28*** | (2006.01) |
| ***H01Q 7/06*** | (2006.01) |
| ***H01Q 1/24*** | (2006.01) |
| ***H01Q 13/00*** | (2006.01) |

(Continued)

(52) U.S. Cl.

CPC ..... *H01P 5/12* (2013.01); *H01Q 1/24* (2013.01); *H01Q 1/38* (2013.01); *H01Q 7/06* (2013.01); *H01Q 9/28* (2013.01); *H01Q 13/00* (2013.01); *H01P 5/024* (2013.01)

(58) Field of Classification Search

CPC ..... H01Q 7/06; H01Q 9/28; H01Q 13/00; H01Q 1/24; H01Q 1/38; H01P 5/12; H01P 3/08

See application file for complete search history.

(56) References Cited

U.S. PATENT DOCUMENTS 5,920,240 A * 7/1999 Alexanian ..... H01P 5/12 330/286
6,181,221 B1 * 1/2001 Kich ..... H01P 5/04 333/125

(Continued)

OTHER PUBLICATIONS

Author Unknown, "Vivaldi antenna," Wikipedia, web page last edited Feb. 7, 2017, accessed May 11, 2017, https://en.wikipedia.org/wiki/Vivaldi_antenna, Wikimedia Foundation, Inc., 2 pages.

(Continued)

*Primary Examiner* — Hoang Nguyen
(74) *Attorney, Agent, or Firm* — Winthrow & Terranova, P.L.L.C.

(57) ABSTRACT

A spatium amplifier includes a plurality of amplifiers connected between a pair of spatial couplers, each having a core member and a shell member forming an antenna. The core member includes a cylindrical core portion and a plurality of tapering core fins extending radially outwardly from the cylindrical core portion. The shell member includes a cylindrical shell portion and a plurality of tapering shell fins extending radially inwardly from the cylindrical shell portion to form a plurality of fin pairs. Each fin pair forms a tapering channel having a first channel height at a first end of the antenna and a second channel height larger than the first channel height at a second end of the antenna. Each of the plurality of amplifiers is electromagnetically coupled to a respective fin pair at the first end of each of the antennas.

20 Claims, 14 Drawing Sheets

(51) Int. Cl.
*H01Q 1/38* (2006.01)
*H01P 5/02* (2006.01)

(56) References Cited

U.S. PATENT DOCUMENTS

| | | | |
|---|---|---|---|
| 7,215,220 | B1 | 5/2007 | Jia |
| 2014/0145794 | A1 | 5/2014 | Courtney et al. |
| 2014/0167880 | A1* | 6/2014 | Daughenbaugh, Jr. ... H01P 5/12 333/127 |

OTHER PUBLICATIONS

Courtney, Patrick G. et al., "120 W Ka Band Power Amplifier Utilizing GaN MMICs and Coaxial Waveguide Spatial Power Combining," White Paper, May 2016, Qorvo, pp. 1-8.
Author Unknown, "Spatial Combining Technology: Revolutionizing the Microwave Power Amplifier," CAP Wireless Inc., Microwave Journal, Sep. 8, 2008, 7 pages, http://www.microwavejournal.com/articles/print/6838-spatial-combining.
Jia, Pengcheng et al., "Broadband High Power Amplifier using Spatial Power Combining Technique" IEEE MTT-S International Microwave Symposium Digest, vol. 3, Jun. 2003, IEEE, 4 pages.
Leggieri, Alberto et al., "The Squarax Spatial Power Combiner," Progress in Electromagnetics Research C, vol. 45, Oct. 2013, pp. 43-55.
Ortiz, Sean C., "High Power Spatial Combiners: Tile and Tray Approaches," Dissertation, North Carolina State University, Electrical Engineering, Nov. 2001, 194 pages.

* cited by examiner

SPATIAL COUPLER AND ANTENNA FOR SPLITTING AND COMBINING ELECTROMAGNETIC SIGNALS

RELATED APPLICATIONS

This application claims priority to provisional patent application Ser. No. 62/271,042, filed Dec. 22, 2015, the disclosure of which is hereby incorporated herein by reference in its entirety.

FIELD OF THE DISCLOSURE

Disclosed embodiments relate generally to spatial couplers, and more specifically to spatial couplers and antennas for splitting and combining electromagnetic signals.

BACKGROUND

In many applications, it may be desirable to amplify electromagnetic (EM) signals, such as radio-frequency (RF) signals for example. In this regard, a conventional spatium amplifier 10 according to the prior art is illustrated in FIG. 1. The conventional spatium amplifier 10 includes an RF input 12 configured to receive an RF input signal, and an RF output 14 configured to output an amplified RF output signal based on the RF input signal. The conventional amplifier includes a radially arranged array 16 of amplifier wedges 18 disposed between the RF input 12 and RF output 14. Each wedge 18, which may also be referred to as a "blade," includes a printed circuit board (PCB) 20 having circuitry 22 configured to amplify a portion of the RF input signal and combine the amplified portion of the RF input signal with the amplified portions of the RF input signal produced by the other wedges 18 to produce the combined amplified RF output signal. The PCB 20 also forms an antenna 24 configured to receive the portion of the RF input signal and output the portion of the amplified RF output signal.

One drawback of this conventional arrangement is that individual wedges 18 are not easily replaceable. In the example illustrated in FIG. 1, the wedges 18 must be precisely machined together, and there is no cost-effective way to machine a replacement wedge 18 for an assembled conventional spatium amplifier 10. Thus, a failure of a single wedge 18 effectively renders the entire conventional spatium amplifier 10 unusable and unrepairable.

Another drawback of this design is that the antenna 24 of each wedge 18 is etched into the PCB 20. This is not desirable at high frequencies (e.g., greater than 26.5 GHz, for example), because the PCB 20 material is not able to accurately capture or pass RF signals at these high frequencies without unacceptable levels of interference. The conventional spatium amplifier 10 also has a poor thermal interface for removing heat from the assembly. Yet another drawback of this design is that it is difficult to obtain hermeticity, i.e., to be sealed with respect to an outside environment. This lack of hermeticity becomes a problem when working with higher frequency RF signals, because small amounts of environmental contamination can interfere with the ability of the conventional spatium amplifier 10 to accurately pass the RF signals. In addition, the lack of hermeticity makes the conventional spatium amplifier 10 less suitable for military and other applications that may subject the conventional spatium amplifier 10 to harsh environmental conditions. Thus, there is a need for an RF amplifier that does not have these drawbacks.

SUMMARY

Disclosed embodiments relate generally to spatial couplers, and more specifically to spatial couplers and antennas for splitting and combining electromagnetic signals. In one embodiment, a spatium amplifier assembly includes a plurality of amplifiers connected between a pair of spatial couplers. Each spatial coupler has a core member and a shell member forming an antenna. The core member includes a cylindrical core portion extending longitudinally between a first end and a second end of the antenna, and a plurality of core fins extending radially outwardly from the cylindrical core portion. Each core fin tapers from a first height with respect to an outer core diameter at the first end of the antenna to a second height smaller than the first height at the second end of the antenna. The shell member includes a cylindrical shell portion extending longitudinally between the first end and the second end of the antenna, and a plurality of shell fins corresponding to the plurality of core fins to form a plurality of fin pairs. The plurality of shell fins extend radially inwardly from the cylindrical shell portion, each of the plurality of shell fins tapering from a third height with respect to an inner shell diameter at the first end of the antenna to a fourth height smaller than the third height at the second end of the antenna. Each fin pair of the plurality of fin pairs forms a tapering channel having a first channel height at the second end of the antenna and a second channel height, which is smaller than the first channel height, at the first end of the antenna. Each of the plurality of amplifiers is electromagnetically coupled to a respective fin pair at the first end of each of the antennas.

In one embodiment, for example, an input antenna of the pair of antennas receives a combined RF input signal, via a coaxial interconnect, for example, and the radially arranged fin pairs split the combined RF input signal into a plurality of split RF input signals. The antenna passes each split RF input signal to a respective amplifier, which amplifies the split RF input signal into an amplified split RF output signal and passes the amplified split RF output signal to an output antenna, i.e., the other of the pair of antennas. The plurality of fin pairs of the output antenna combine the amplified split RF output signals into an amplified combined RF output signal.

One advantage of this embodiment is that an individual amplifier may be individually replaced by simply disconnecting the input antenna and output antenna, replacing the individual amplifier, and reconnecting the input antenna and output antenna. In addition, because the antennas do not need to be etched into the PCB of the amplifiers, the antennas are able to accurately and efficiently handle high frequency RF signals. This embodiment also has high hermeticity, which is beneficial to the performance of the antennas at high RF frequencies, and which also makes the spatial coupler more suitable for military and other applications that may subject the spatium amplifier assembly to harsh environmental conditions.

In one embodiment, an antenna assembly for a spatial coupler is disclosed. The antenna assembly comprises a core member comprising a cylindrical core portion extending longitudinally between a first end and a second end of the antenna assembly, the cylindrical core portion defining an outer core diameter. The core member further comprises a plurality of core fins extending radially outwardly from the cylindrical core portion, each of the plurality of core fins tapering from a first height at the first end of the antenna assembly to a second height smaller than the first height at the second end of the antenna assembly. The antenna assembly further comprises a shell member disposed around the core member. The shell member comprises a cylindrical shell portion extending longitudinally between the first end and the second end of the antenna assembly, the cylindrical shell portion defining an inner shell diameter. The shell member further comprises a plurality of shell fins corresponding to the plurality of core fins to form a plurality of fin pairs, the plurality of shell fins extending radially inwardly from the cylindrical shell portion, each of the plurality of shell fins tapering from a third height at the first end of the antenna assembly to a fourth height smaller than the third height at the second end of the antenna assembly. Each fin pair of the plurality of fin pairs forms a tapering channel therebetween, the tapering channel having a first channel height at the second end of the antenna assembly and a second channel height, which is smaller than the first channel height, at the first end of the antenna assembly.

In another embodiment, a spatial coupler assembly is disclosed. The spatial coupler assembly comprises an antenna sub-assembly comprising a core member. The core member comprises a cylindrical core portion extending longitudinally between a first end and a second end of the antenna sub-assembly, the cylindrical core portion defining an outer core diameter. The core member further comprises a plurality of core fins extending radially outwardly from the cylindrical core portion, each of the plurality of core fins tapering from a first height at the first end of the antenna sub-assembly to a second height smaller than the first height at the second end of the antenna sub-assembly. The antenna sub-assembly further comprises a shell member disposed around the core member. The shell member comprises a cylindrical shell portion extending longitudinally between the first end and the second end of the antenna sub-assembly, the cylindrical shell portion defining an inner shell diameter. The shell member further comprises a plurality of shell fins corresponding to the plurality of core fins to form a plurality of fin pairs, the plurality of shell fins extending radially inwardly from the cylindrical shell portion, each of the plurality of shell fins tapering from a third height at the first end of the antenna sub-assembly to a fourth height smaller than the third height at the second end of the antenna sub-assembly. Each fin pair of the plurality of fin pairs forms a tapering channel therebetween, the tapering channel having a first channel height at the second end of the antenna assembly and a second channel height, which is smaller than the first channel height, at the first end of the antenna assembly. The spatial coupler assembly further comprises a plurality of amplifiers, each electromagnetically coupled to a respective fin pair at the first end of the antenna sub-assembly.

In another embodiment, a method of assembling a spatial coupler is disclosed. The method comprises disposing a shell member around a core member to form an antenna sub-assembly having a first end and a second end. A plurality of shell fins of the cylindrical shell portion extend radially inwardly from a cylindrical shell portion of the shell member and a plurality of core fins corresponding to the plurality of shell fins extend radially outwardly from a cylindrical core portion. The method further comprises aligning the plurality of shell fins with the plurality of core fins to form a plurality of fin pairs, each fin pair forming a tapering channel therebetween. Each tapering channel tapers from a first width at the second end of the antenna sub-assembly to a second width, which is smaller than the first width, at the first end of the antenna sub-assembly.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 11:
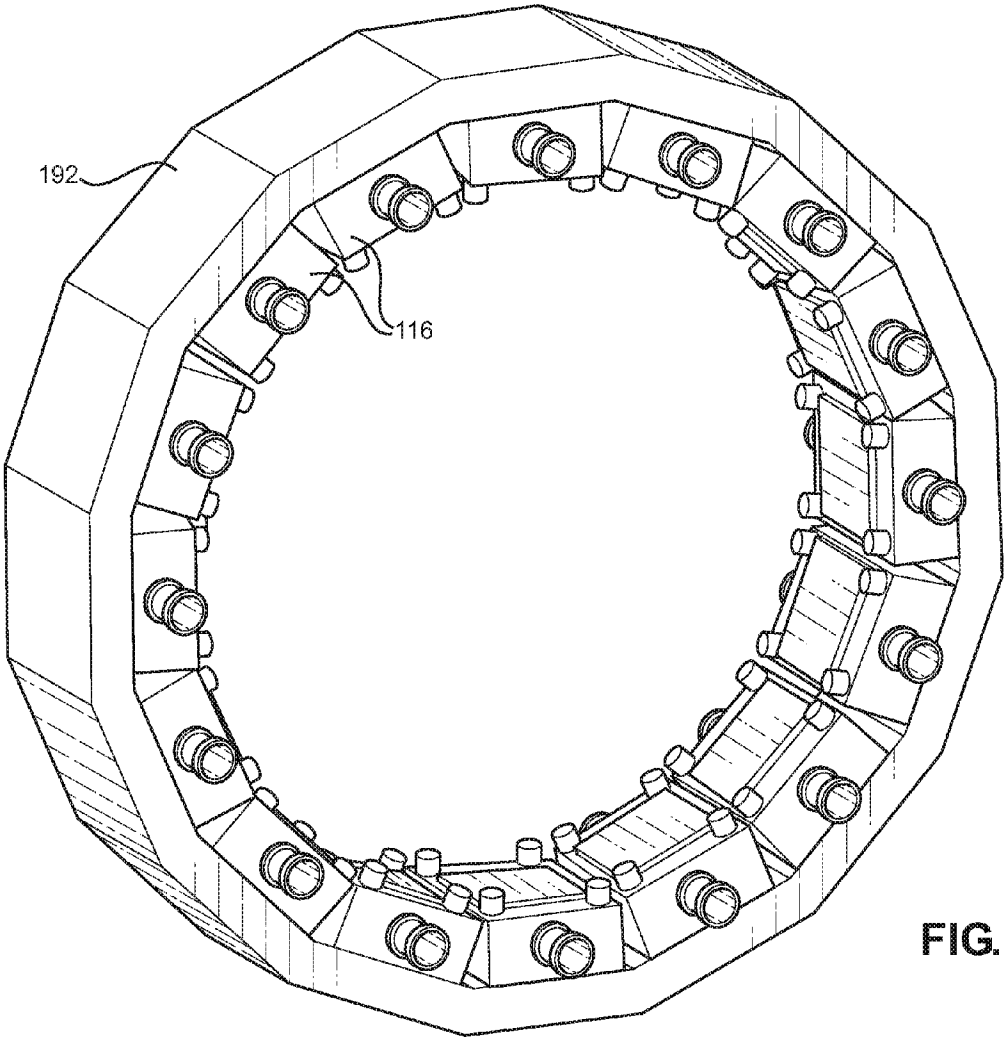
Figure 12:
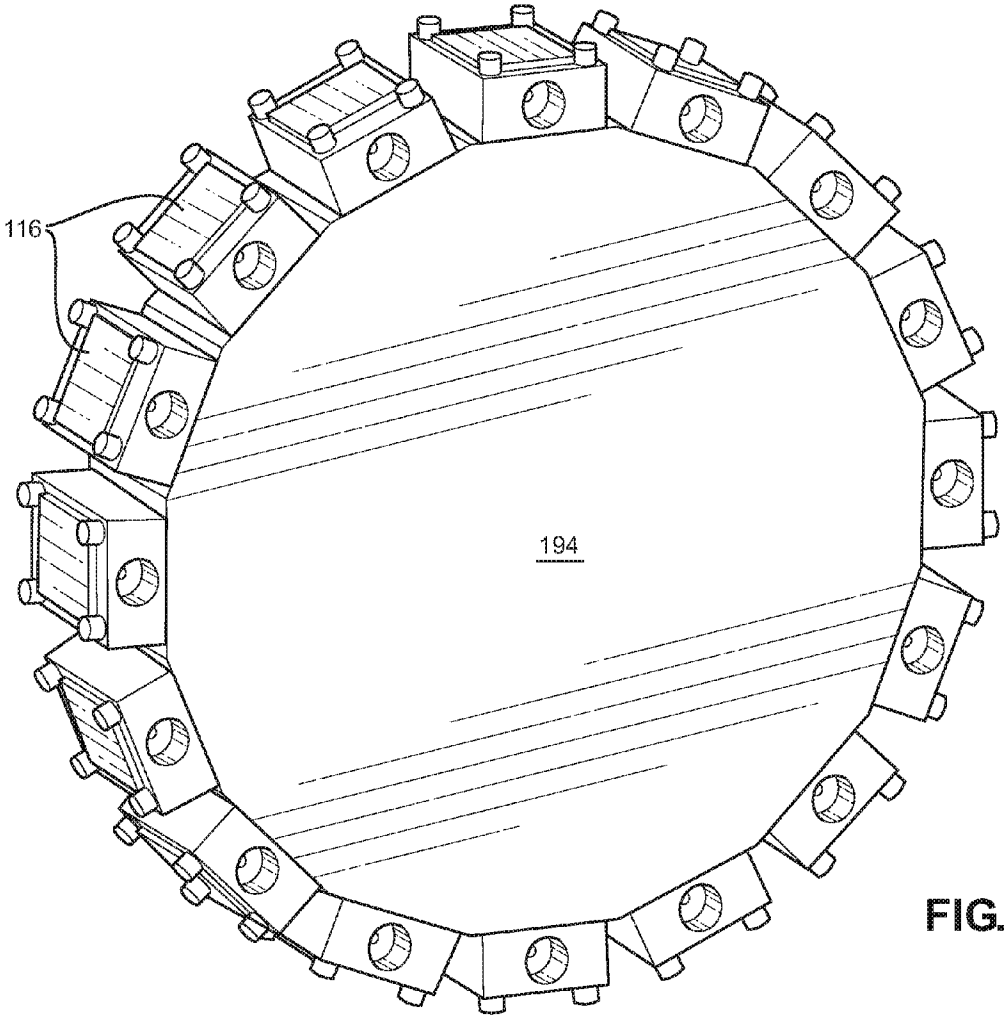

FIG. 11 illustrates an alternative heat sink for a spatium amplifier assembly having a substantially annular profile for facilitating packaging of the spatium amplifier assembly, according to an embodiment; and FIG. 12 illustrates an alternative heat sink for a spatium amplifier assembly having a substantially disc-shaped profile for facilitating convection cooling of the spatium amplifier assembly, according to an embodiment.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. The term "substantially" used herein in conjunction with a numeric value means any value that is within a range of five percent greater than or five percent less than the numeric value.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Disclosed embodiments relate generally to spatial couplers, and more specifically to spatial couplers and antennas for splitting and combining electromagnetic signals. In one embodiment, a spatium amplifier assembly includes a plurality of amplifiers connected between a pair of spatial couplers. Each spatial coupler has a core member and a shell member forming an antenna. The core member includes a cylindrical core portion extending longitudinally between a first end and a second end of the antenna, and a plurality of core fins extending radially outwardly from the cylindrical core portion. Each core fin tapers from a first height with respect to an outer core diameter at the first end of the antenna to a second height smaller than the first height at the second end of the antenna. The shell member includes a cylindrical shell portion extending longitudinally between the first end and the second end of the antenna, and a plurality of shell fins corresponding to the plurality of core fins to form a plurality of fin pairs. The plurality of shell fins extend radially inwardly from the cylindrical shell portion, each of the plurality of shell fins tapering from a third height with respect to an inner shell diameter at the first end of the antenna to a fourth height smaller than the third height at the second end of the antenna. Each fin pair of the plurality of fin pairs forms a tapering channel having a first channel height at the second end of the antenna and a second channel height, which is smaller than the first channel height, at the first end of the antenna. Each of the plurality of amplifiers is electromagnetically coupled to a respective fin pair at the first end of each of the antennas.

In one embodiment, for example, an input antenna of the pair of antennas receives a combined RF input signal, via a coaxial interconnect, for example, and the radially arranged fin pairs split the combined RF input signal into a plurality of split RF input signals. The antenna passes each split RF input signal to a respective amplifier, which amplifies the split RF input signal into an amplified split RF output signal and passes the amplified split RF output signal to an output antenna, i.e., the other of the pair of antennas. The plurality of fin pairs of the output antenna combine the amplified split RF output signals into an amplified combined RF output signal.

One advantage of this embodiment is that an individual amplifier may be individually replaced by simply disconnecting the input antenna and output antenna, replacing the individual amplifier, and reconnecting the input antenna and output antenna. In addition, because the antennas do not need to be etched into the PCB of the amplifiers, the antennas are able to accurately and efficiently handle high frequency RF signals. This embodiment also has high hermeticity, which is beneficial to the performance of the antennas at high RF frequencies, and which also makes the spatial coupler more suitable for military and other applications that may subject the spatium amplifier assembly to hard environmental conditions.

Figure 2:
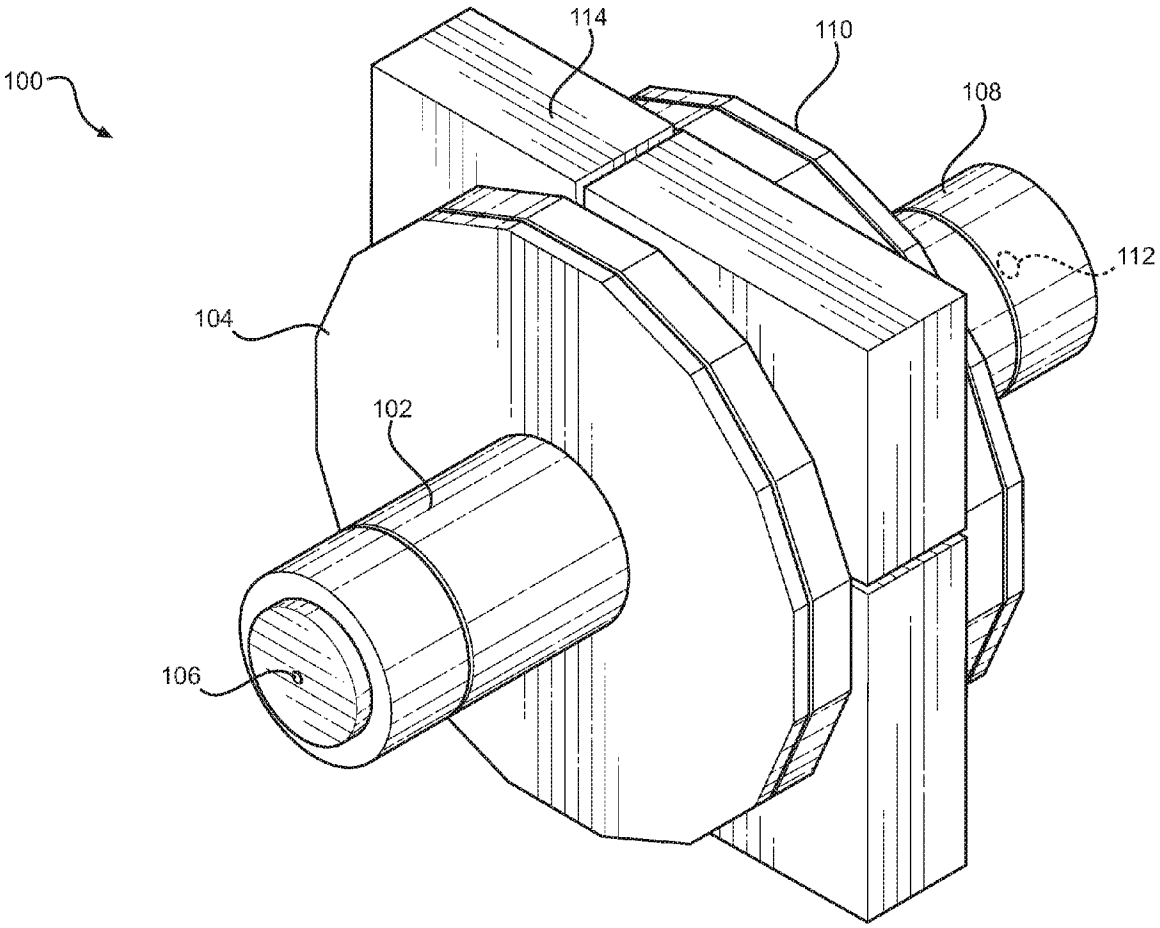
FIG. 2 illustrates a spatium amplifier assembly having a spatial splitter sub-assembly and a spatial combiner sub-assembly, according to an embodiment.

In this regard, FIG. 2 illustrates a mixed mode spatium amplifier assembly 100 according to an embodiment. The spatium amplifier assembly 100 has a first spatial coupler sub-assembly 102, which may also be referred to herein as a spatial coupler, a spatial splitter, or a spatial splitter sub-assembly, comprising a coupler housing 104 and a coaxial input 106. The spatium amplifier assembly 100 also has a second spatial coupler sub-assembly 108, which may also be referred to herein as a spatial coupler, a spatial combiner, or a spatial combiner sub-assembly, comprising a coupler housing 110 and a coaxial output 112. A plurality of amplifiers 116 (illustrated in FIGS. 3A-3B et al.) are electromagnetically coupled between the spatial splitter sub-assembly 102 and the spatial combiner sub-assembly 108. The amplifiers 116 are encircled by a plurality of heat sinks 114, which enclose and seal the amplifiers 116 between the spatial splitter sub-assembly 102 and the spatial combiner sub-assembly 108.

Figure 3A:
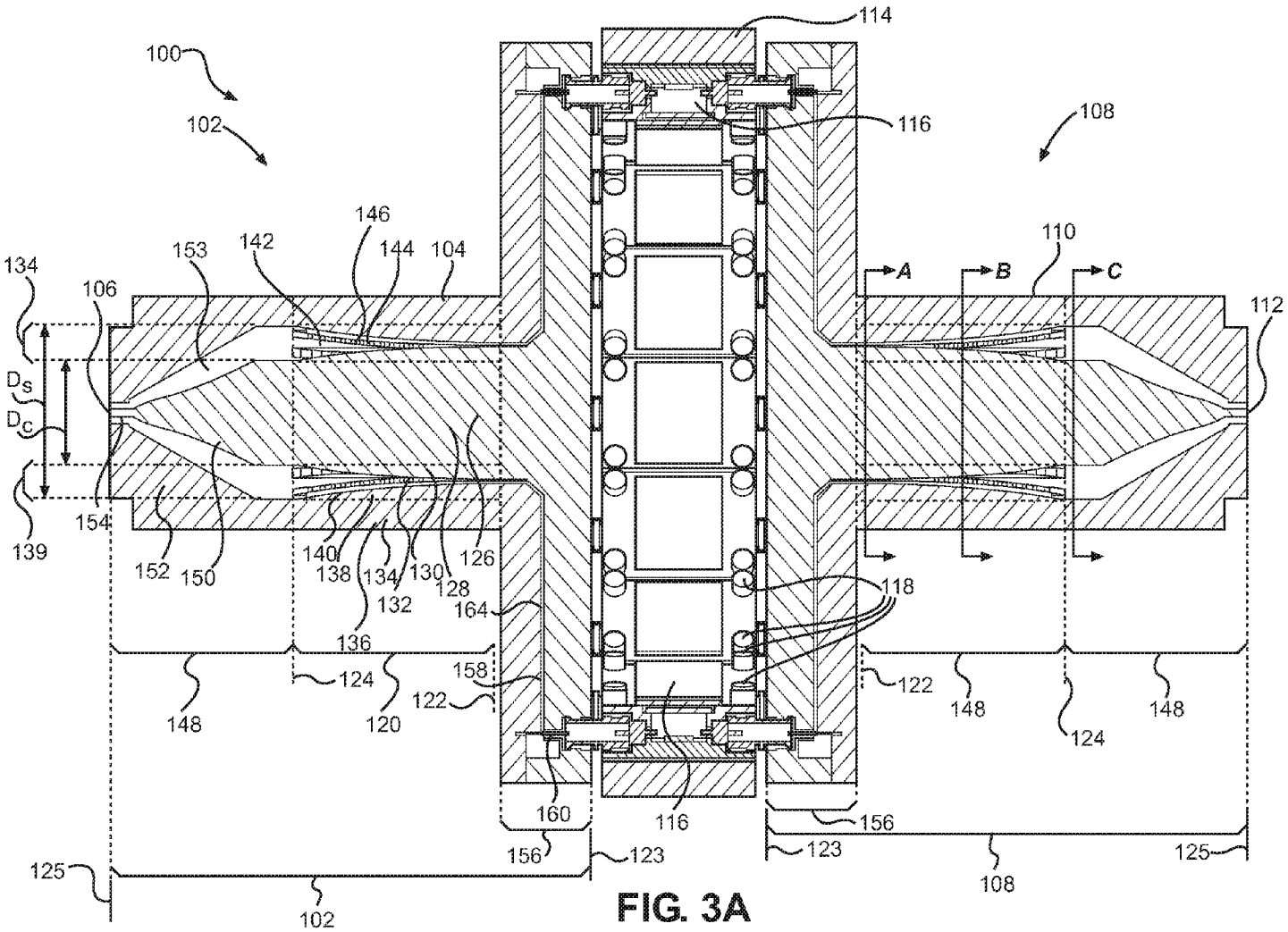
FIGS. 3A and 3B illustrate side and perspective cutaway views of the spatium amplifier assembly of FIG. 2, taken along a plane passing through a longitudinal axis of the spatium amplifier assembly, according to an embodiment.
Figure 3B:
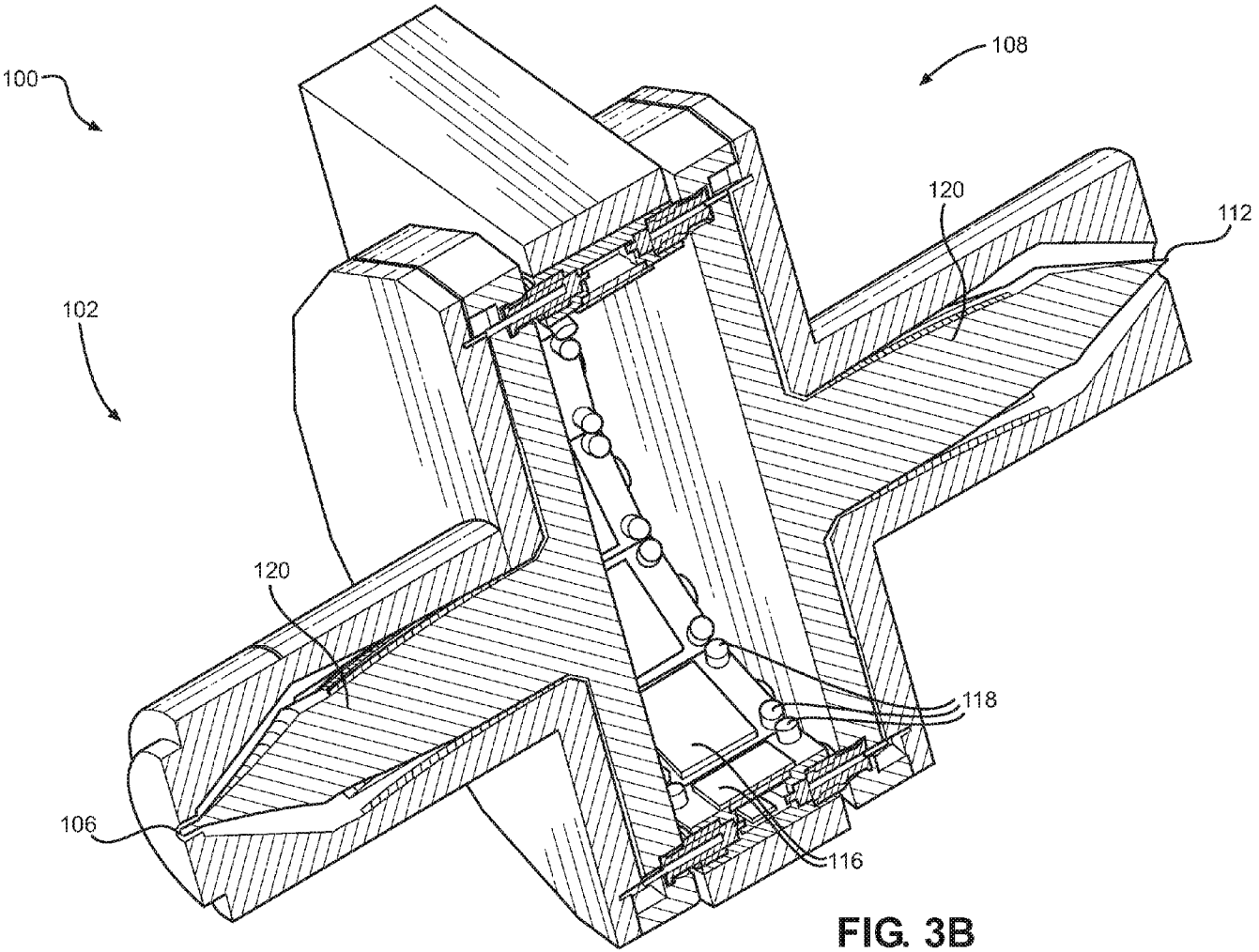

In order to discuss the internal components of the spatium amplifier assembly 100 in greater detail, FIGS. 3A and 3B illustrate side and perspective cutaway views of the spatium amplifier assembly 100. The amplifiers 116 in this embodiment are arranged radially around an interior surface of the heat sinks 114. Each amplifier 116 is fastened to the heatsink(s) 114 via a plurality of heatsink fasteners 118. The heatsink fasteners 118 in this embodiment are threaded fasteners, such as 0-80 machine screws in this embodiment, but it should be understood that other types of fastening methods may be used, such as bolts, thermally conductive adhesives, etc., as is known in the art.

Each spatial coupler sub-assembly 102, 108 forms an antenna sub-assembly 120 that extends between a first end 122, proximate to a first end 123 of the respective spatial coupler sub-assembly 102, 108, and a second end 124, proximate to a second end 125 of the respective spatial coupler sub-assembly 102, 108. The first end 123 of each spatial coupler sub-assembly 102, 108 is proximate to the amplifiers 116, and the second end 125 of each spatial coupler sub-assembly 102, 108 is proximate to the respective input 106 or output 112. Each antenna sub-assembly 120 includes a core member 126 having a cylindrical core portion 128 extending longitudinally between the first end 122 and the second end 124 of the antenna sub-assembly 120, with the cylindrical core portion 128 defining an outer core diameter $D_C$. Each core member 126 includes a plurality of core fins 130 extending radially outwardly from the cylindrical core portion 128. Each of the plurality of core fins 130 has a tapering surface 132 that tapers from a first height $H_1$ with respect to the cylindrical core portion 128 at the first end 122 of the antenna sub-assembly 120 (see FIG. 4A, which is a cross section of the antenna sub-assembly 120 along cut-line A in FIG. 3A). The tapering surface 132 tapers to a second height $H_2$ (see FIG. 4B, which is a cross section of the antenna sub-assembly 120 along cut-line B in FIG. 3A) that is smaller than the first height $H_1$ at the midpoint of the antenna sub-assembly 120, and to a third height that is substantially 0 in this embodiment (See FIG. 4C, which is a cross section of the antenna sub-assembly 120 along cut-line C in FIG. 3A) at the second end of the antenna sub-assembly 120.

The antenna sub-assembly 120 also includes a shell member 134 disposed around the core member 126. The shell member 134 comprises a cylindrical shell portion 136 extending longitudinally between the first end 122 and the second end 124 of the antenna sub-assembly 120, with the cylindrical shell portion 136 defining an inner shell diameter $D_S$. The shell member 134 further comprises a plurality of shell fins 138 corresponding to the plurality of core fins 130 to form a plurality of fin pairs 139. The plurality of shell fins 138 extend radially inwardly from the cylindrical shell portion 136. Each of the plurality of shell fins 138 has a tapering surface 140 that tapers from a third height $H_3$ with respect to the cylindrical shell portion 136 at the first end 122 of the antenna sub-assembly 120 to a fourth height $H_4$ smaller than the third height $H_3$ at the second end 124 of the antenna sub-assembly 120 (see FIGS. 4A and 4B). In this embodiment, each core fin 130 is symmetrical with the corresponding shell fin 138 of the fin pair 139, such that $H_1$ is equal to $H_3$ and $H_2$ is equal to $H_4$, but it should be understood that other arrangements are contemplated. In this embodiment, for example, the tapering surfaces 132, 140 have an exponential (i.e., Vivaldi type) taper. It should be understood that the dashed lines in this embodiment do not necessarily indicate that components are non-unitary with each other. For example, in this embodiment, the core fins 130 are unitary with the cylindrical core portion 128 and the shell fins 138 are unitary with the cylindrical shell portion.

Each fin pair 139 forms a radial channel on either side of the fin pair 139 with a respective adjacent fin pair 139. Each fin pair 139 also forms a tapering channel 144 therebetween, the channel having a first channel height $H_5$ at the first end 122 of the antenna sub-assembly 120 and a second channel height $H_6$ larger than the first channel height $H_5$ at the second end 124 of the antenna sub-assembly 120. In this embodiment, the sum of the core fin height, channel height, and shell fin height is constant along the length the antenna sub-assembly 120. For example, the sum of $H_1$, $H_3$, and $H_5$ are equal to the sum of $H_2$, $H_4$, and $H_6$.

Each tapering channel 144 forms a waveguide 146, which may be referred to herein as a double-ridge or horn-style waveguide. For the spatial splitter sub-assembly 102, a combined RF input signal is received by the antenna via a coaxial interface 148 disposed at the second end 125 of the spatial splitter sub-assembly 102. In this example, the coaxial interface 148 comprises a tapering core portion 150 coupled to the cylindrical core portion 128 of the core member 126 at the second end 124 of the antenna sub-assembly 120. The tapering core portion 150 is surrounded by a tapering shell portion 152 coupled to the cylindrical shell portion 136 of the shell member 134 at the second end 124 of the antenna sub-assembly 120. The tapering core portion 150 and the tapering shell portion 152 form an annular tapering channel 153 extending between the second end 124 of the antenna sub-assembly 120 and a coaxial interconnect 154 at the input 106 of the spatial splitter sub-assembly 102. In this embodiment, the tapering channel 153 has a coaxial profile.

The combined RF input signal is received from the input 106 via the coaxial interconnect 154 and passed through the coaxial interface to the second end 124 of the antenna sub-assembly 120. As each of the plurality of tapering channels 144 narrows, i.e., as the heights of the respective core fin 130 and shell fin 138 of each fin pair 139 increase, the tapering channels 144 act as waveguides 146 to split the combined RF input signal into a plurality of split RF input signals, each corresponding to a respective waveguide 146.

The split RF input signals are next passed to a waveguide interface 156 comprising a plurality of radially arranged waveguide channels 158. Each waveguide channel 158 is configured to pass a split RF input signal from a respective waveguide 146 to a coaxial interface 148 for one of the plurality of amplifiers 116. In this embodiment, the waveguide interface 156 also comprises a transition channel 162 disposed between the tapering channel 144 of the waveguide 146 and the radially extending waveguide channel 158 to guide the split RF input signal from the longitudinally extending tapering channel 144 to the radially extending waveguide channel 158.

Each amplifier 116 amplifies the respective split RF input signal to generate an amplified split RF output signal and outputs the amplified split RF output signal to a coaxial interconnect 160 of the spatial combiner sub-assembly 108 coupled to the output side of the amplifiers 116. In this embodiment, the structure of the spatial combiner sub-assembly 108 is identical to the structure of the spatial splitter sub-assembly 102, but it should be understood that identical structure is not required. In this embodiment, the waveguide channels 158 of the waveguide interface 156 at the first end 123 of the spatial combiner sub-assembly 108 pass the respective amplified split RF output signals to the first end 122 of the antenna sub-assembly 120 of the spatial combiner sub-assembly 108. Here, the amplified split RF output signals are received at the narrow ends of the tapering channels 144 of waveguides 146. As the tapering channels 144 widen along the length of the antenna sub-assembly 120, the amplified split RF output signals are combined into an amplified combined RF output signal and passed to the output 112 of the spatial combiner sub-assembly 108 via the coaxial interface 148 and coaxial interconnect 154 of the spatial combiner sub-assembly 108.

The spatium amplifier assembly 100 in this embodiment is a type II spatium, but it should be understood that other configurations are contemplated. This embodiment is also particularly well suited to high-frequency applications, such as frequencies in the Ka band (i.e., 26.5 GHz-40 GHz) and above, for example. Broadband response is also achievable.

Figure 4C:
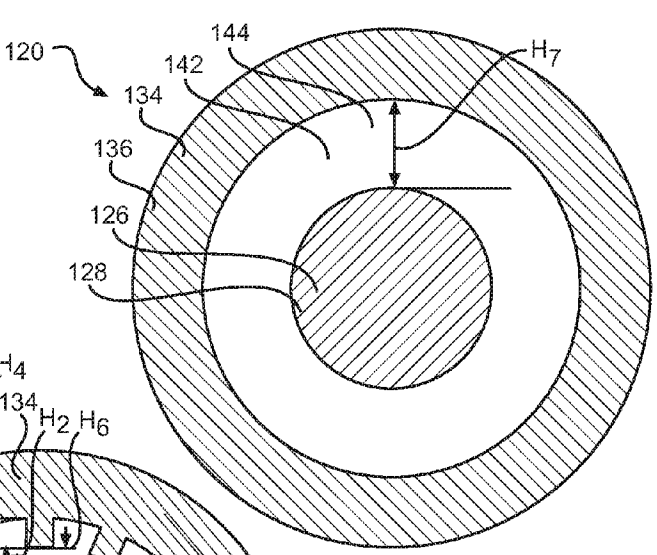
FIGS. 4A-4C illustrate cross sections of the waveguides at different positions along the length of the antenna sub-assembly of the spatium amplifier assembly of FIG. 2, illustrating the changes in height of the tapering gaps between the plurality of fin pairs, according to an embodiment.
Figure 4B:
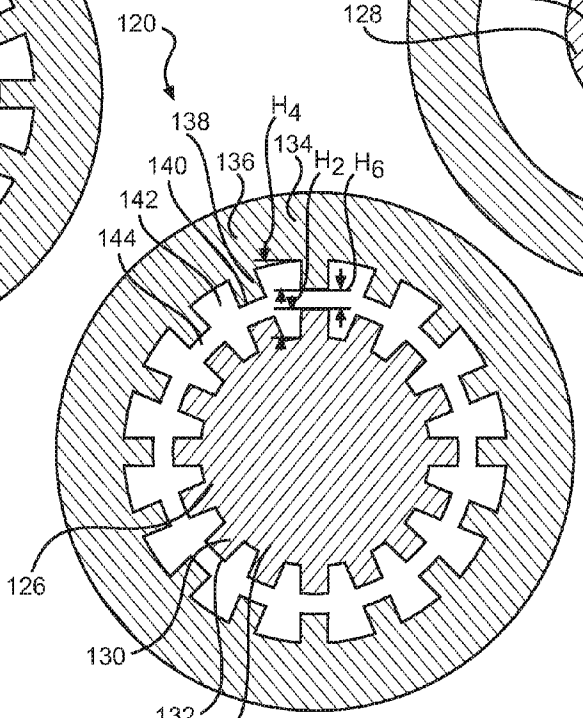
Figure 4A:
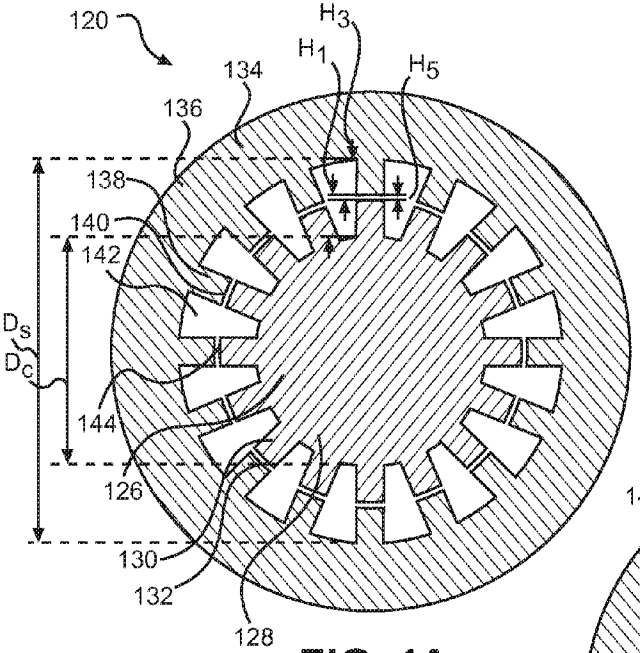

As discussed above, FIGS. 4A-4C are cutaway views of the antenna sub-assembly that illustrate cross sections of the waveguides 146 between the first end 122 and the second end 124 of the antenna sub-assembly 120 at respective cut lines A-C of FIG. 3B. In this regard, FIG. 4A illustrates a cross section of the waveguides 146 proximate to the first end 122 of the antenna sub-assembly 120, in which the tapering channel 144 has a relatively narrow channel height $H_5$ configured to pass the split RF input signal or amplified split RF output signal. FIG. 4B illustrates a cross section of the waveguides 146 proximate a midpoint of the antenna sub-assembly 120. Here, the channel height $H_6$ of the tapering channels 144 are significantly larger, and are configured to transition the antenna sub-assembly 120 between the first end 122 having multiple waveguides 146 for passing multiple split RF signals and the second end 124 of the antenna sub-assembly 120. As shown by FIG. 4C, the channel height $H_7$ of the tapering channel 144 is equal to the constant height of the radial channels 142 to form a substantially uniform annular channel for passing a combined RF signal.

FIGS. 3A and 3B illustrate cutaway views of the spatium amplifier assembly 100 along a plane that bisects a pair of waveguides 146 on each of the spatial coupler sub-assemblies 102, 108, in order to better illustrate the details of the fin pairs 139 and the tapering channels 144 formed thereby. To better illustrate details of the radial channels 142, FIGS. 5A and 5B illustrate side and perspective cutaway views of the spatium amplifier assembly 100 along a plane horizontally offset from the longitudinal axis of the spatium amplifier assembly 100.

Figure 5A:
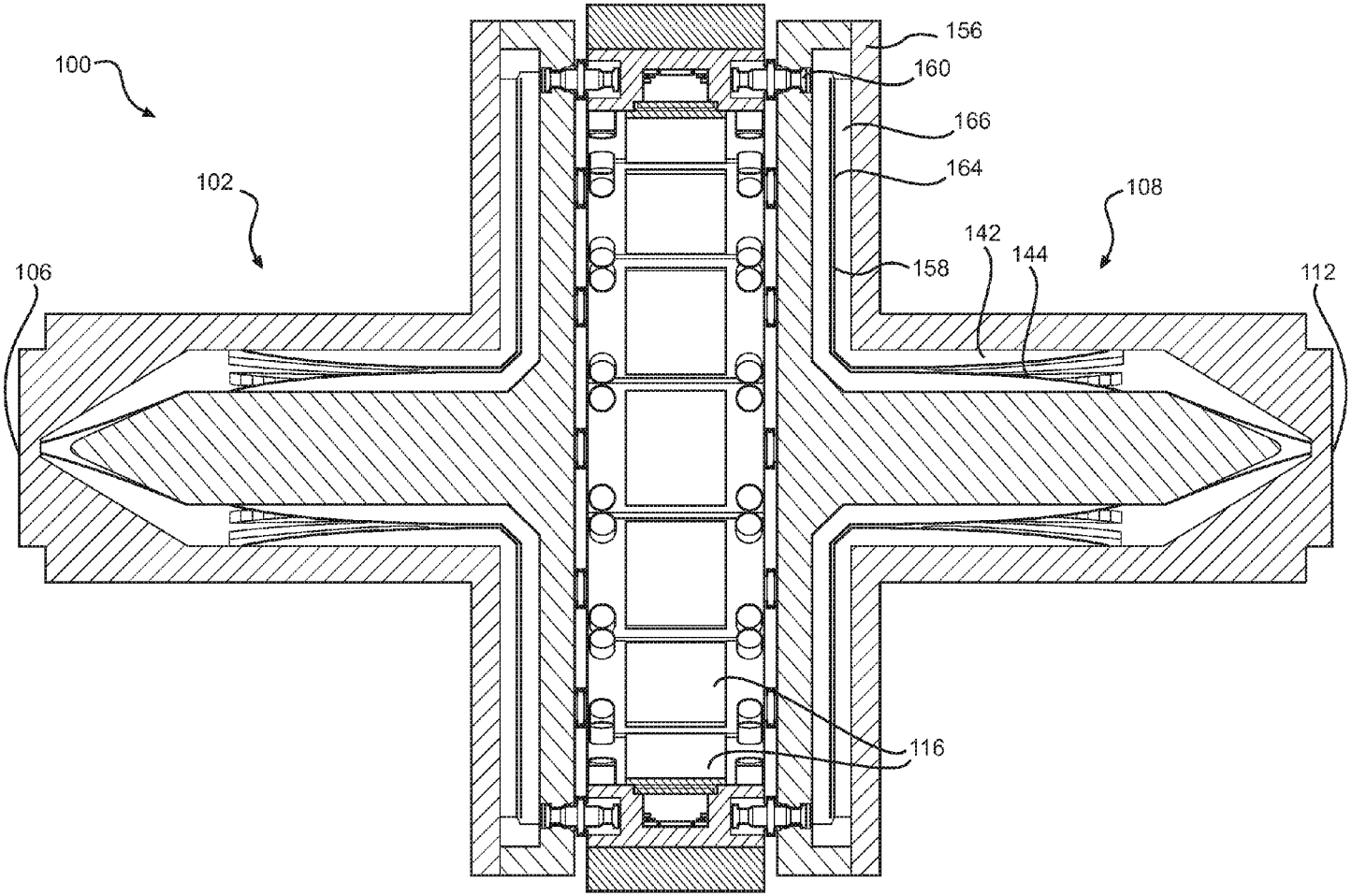
FIGS. 5A and 5B illustrate side and perspective cutaway views of the spatium amplifier assembly of FIG. 2, taken along a plane offset from the longitudinal axis of the spatium amplifier assembly, according to an embodiment.
Figure 5B:
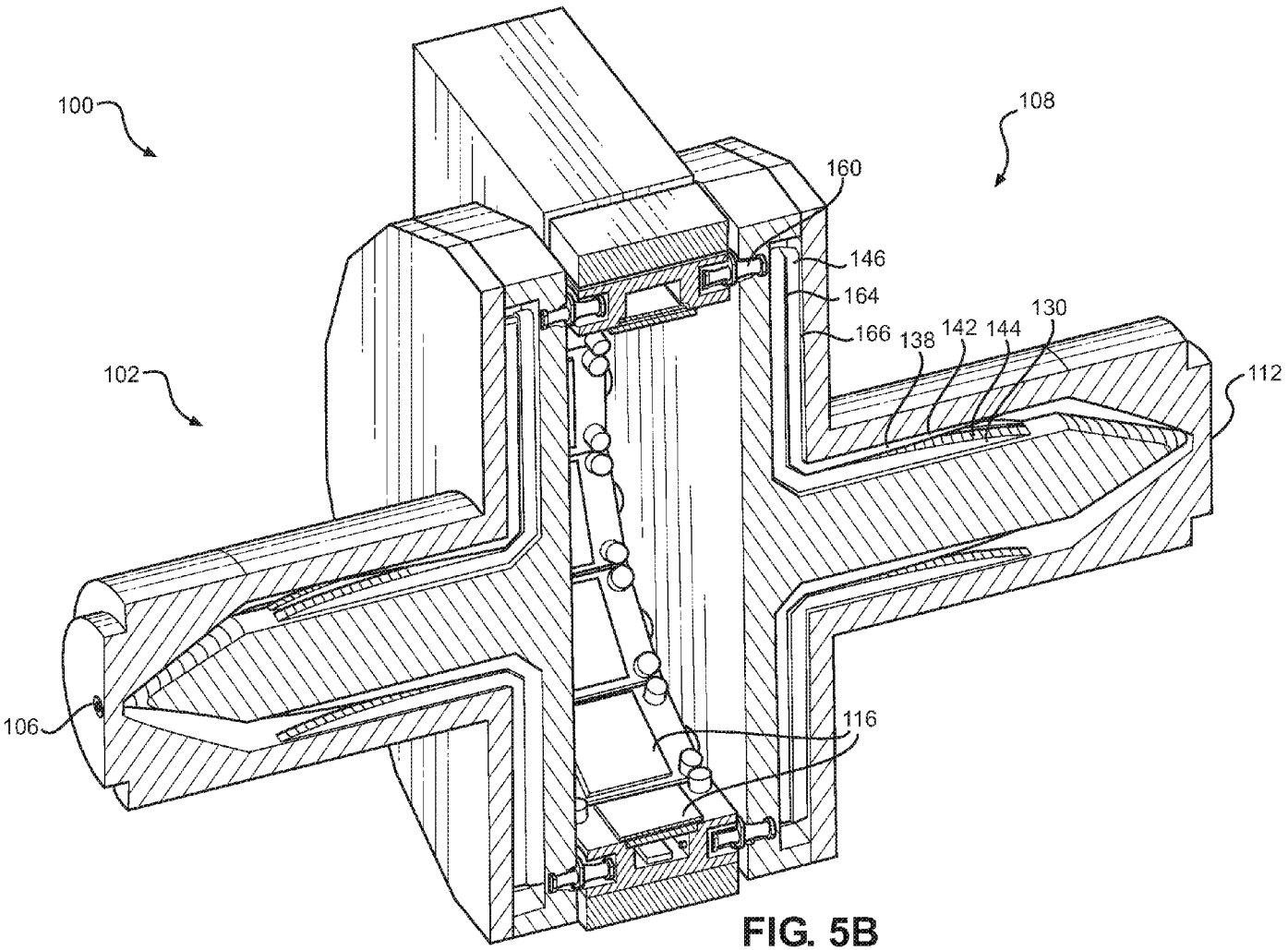
Figure 6B:
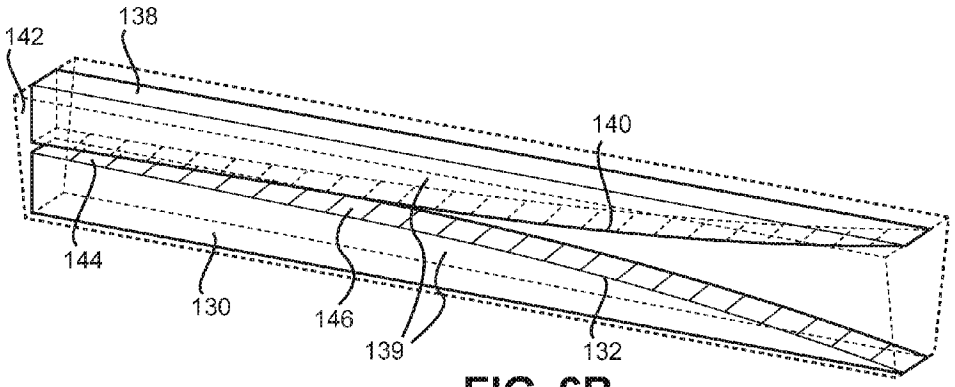
FIGS. 6A and 6B illustrate isolated isometric views of portions of the channels associated with one fin pair of the antenna sub-assembly of the spatium amplifier assembly of FIG. 2, according to an embodiment.
Figure 6A:
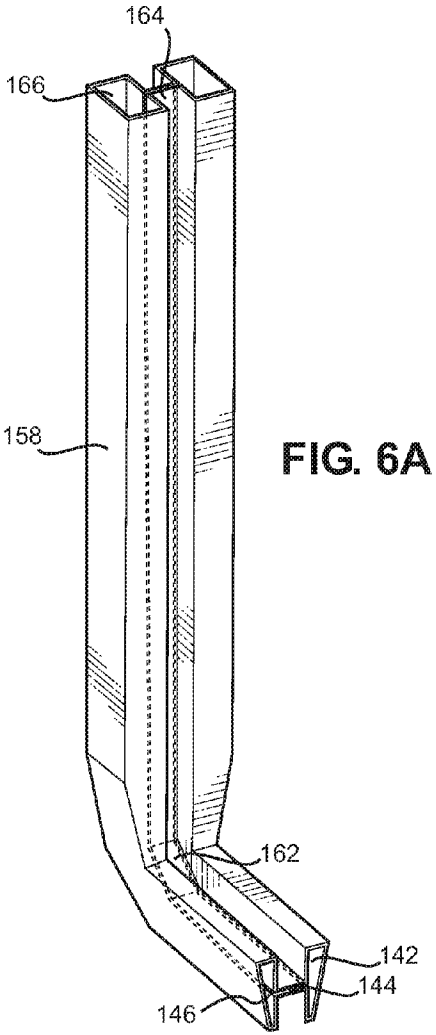

In FIGS. 5A and 5B as well, it can be seen that each waveguide channel 158 of the waveguide interface 156 includes a narrow channel portion 164 with a wide channel portion 166 disposed on either side of the narrow channel portion 164. In this regard, FIGS. 6A and 6B illustrate an isolated isometric view of a portion of the channels associated with one fin pair 139 of an antenna sub-assembly 120. In FIG. 6A, it can be seen that the tapering channel 144 disposed between the adjacent radial channels 142 forms a generally H-shaped cross-section, configured to be arranged radially between the generally cylindrical core member 126 and shell member 134 of the antenna sub-assembly 120 (See FIGS. 4A-4C). Each waveguide channel 158 is connected to the waveguide 146 via the transition channel 162, and has a generally uniform cross section configured to pass the split RF signals between the antenna sub-assemblies 120 and the coaxial interconnects 160 of the respective spatial coupler sub-assemblies 102, 108 (See FIGS. 3A-5B). FIG. 6B illustrates how the tapering channel 144 tapers between a generally H-shaped cross section at the first end 122 of the antenna sub-assembly 120 and a generally annular wedge-shaped cross section at the second end 124 of the antenna sub-assembly 120 (See also FIGS. 4A-4C).

Figure 7:
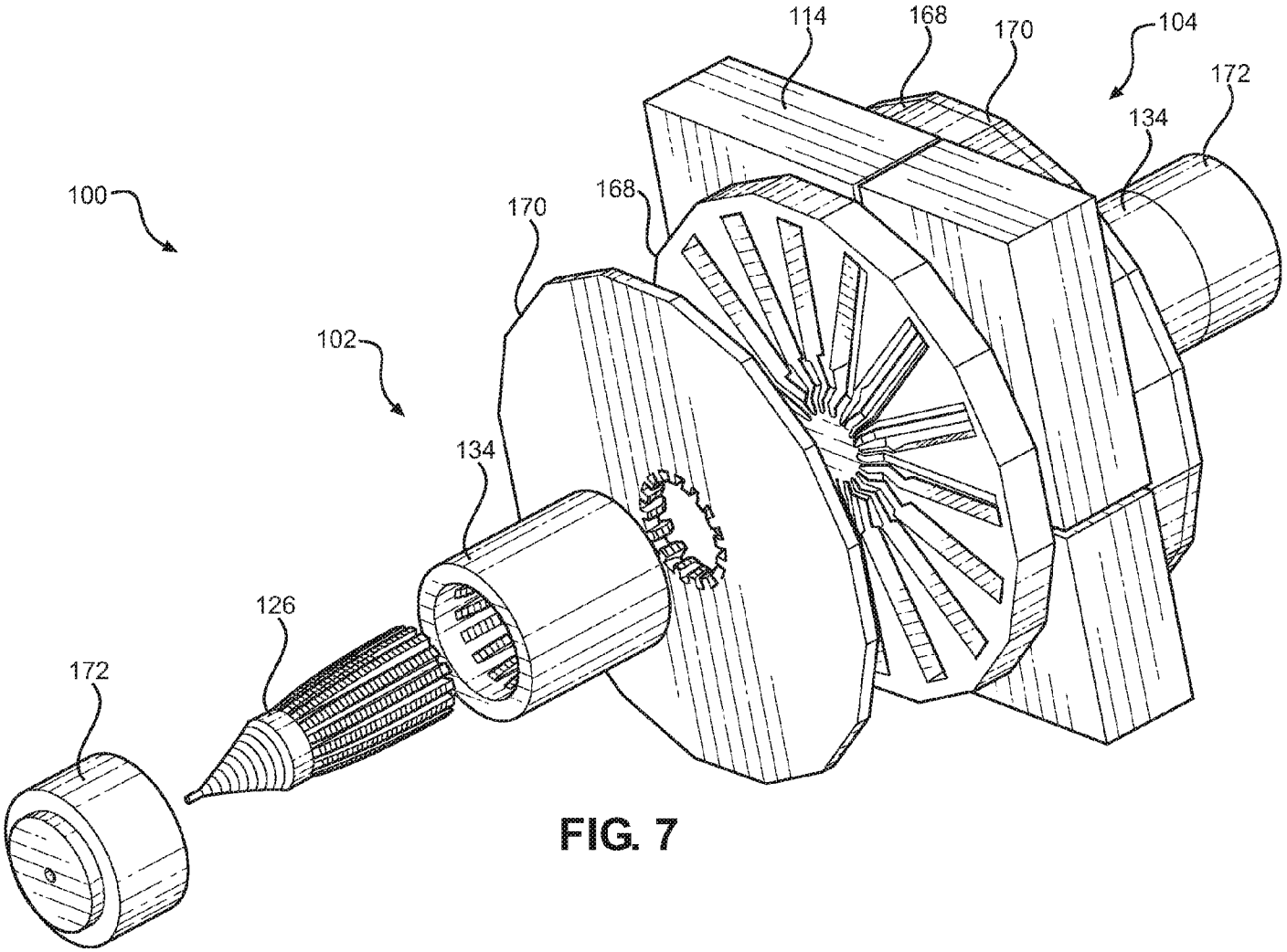
FIG. 7 illustrates an exploded perspective view of the spatium amplifier assembly of FIG. 2 illustrating a method of assembly for the antenna sub-assemblies, according to an embodiment.

One advantage of this and other embodiments is that spatial amplifiers can be assembled more simply and easily, and with higher hermeticity, than conventional spatial amplifiers. In this regard, FIG. 7 illustrates an exploded perspective view of the spatium amplifier assembly 100 described above. In this embodiment, for each of the spatial coupler sub-assemblies 102, 108, the waveguide interface 156 includes a waveguide interface member 168, coupled to the amplifiers 116 and the heat sink 114, and a waveguide cover member 170 that covers the waveguide interface member 168 to form the waveguide channels 158 and transition channels therebetween. The shell member 134 in this embodiment is coupled to the waveguide cover member 170, and the core member 126 is disposed within the shell member 134 and coupled to the waveguide interface member 168 through an opening in the waveguide cover member 170. A coaxial cap member 172 containing the tapering shell portion 152 of the coaxial interface 148 is coupled to the shell member 134 to surround the tapering core portion 150 and form the coaxial interface 148.

Figure 8:
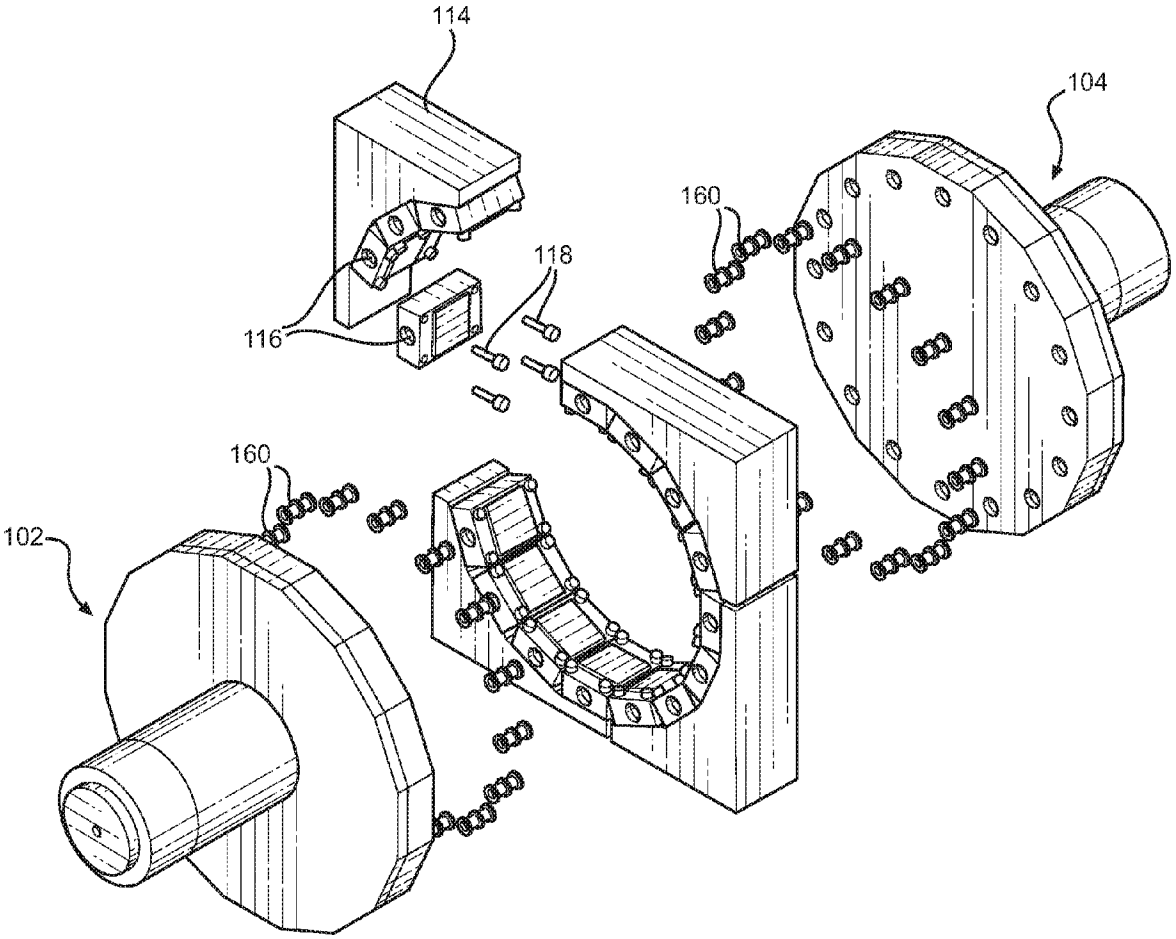
FIG. 8 illustrates an exploded perspective view of the spatium amplifier assembly of FIG. 2 illustrating a method of assembly for the spatium amplifier assembly, according to an embodiment.

FIG. 8 illustrates assembly of the amplifiers 116 in the space formed by the heat sinks 114 and spatial coupler sub-assemblies 102, 108. As shown in FIG. 8, each amplifier 116 is fastened to the heat sinks 114 via heatsink fasteners 118. The heat sinks 114 are arranged to dispose the amplifiers 116 in a ring, and the spatial coupler sub-assemblies 102, 108 are coupled on either side of the amplifiers 116 via coaxial interconnects 160. In this manner, the heat sinks 114 and spatial coupler sub-assemblies 102, 108, which are all formed from metal in this embodiment, form a hermetic seal around the amplifiers 116. One advantage of using an all-metal design is that signal loss is reduced compared to spatial couplers that use other types of materials. In this embodiment, the amplifiers 116 may be surrounded by a liquid coolant enclosed in the spatium amplifier assembly 100.

One advantage of this arrangement is that the components of the spatial coupler sub-assemblies 102, 108 and the heat sinks 114 all couple to each other along surfaces that are parallel to each other and to the coupling surfaces of the other components. In contrast to the wedge array 16 of the conventional spatium amplifier 10 of FIG. 1, forming the coupling surfaces of the components of the spatium amplifier assembly 100 in the manner allows for a hermetic seal to be achieved for a significantly lower expense, because components of spatium amplifier assembly 100 do not need to be machined to strict tolerances in as many dimensions and/or at as many angles as the prior art wedge array 16 of FIG. 1.

Figure 1:
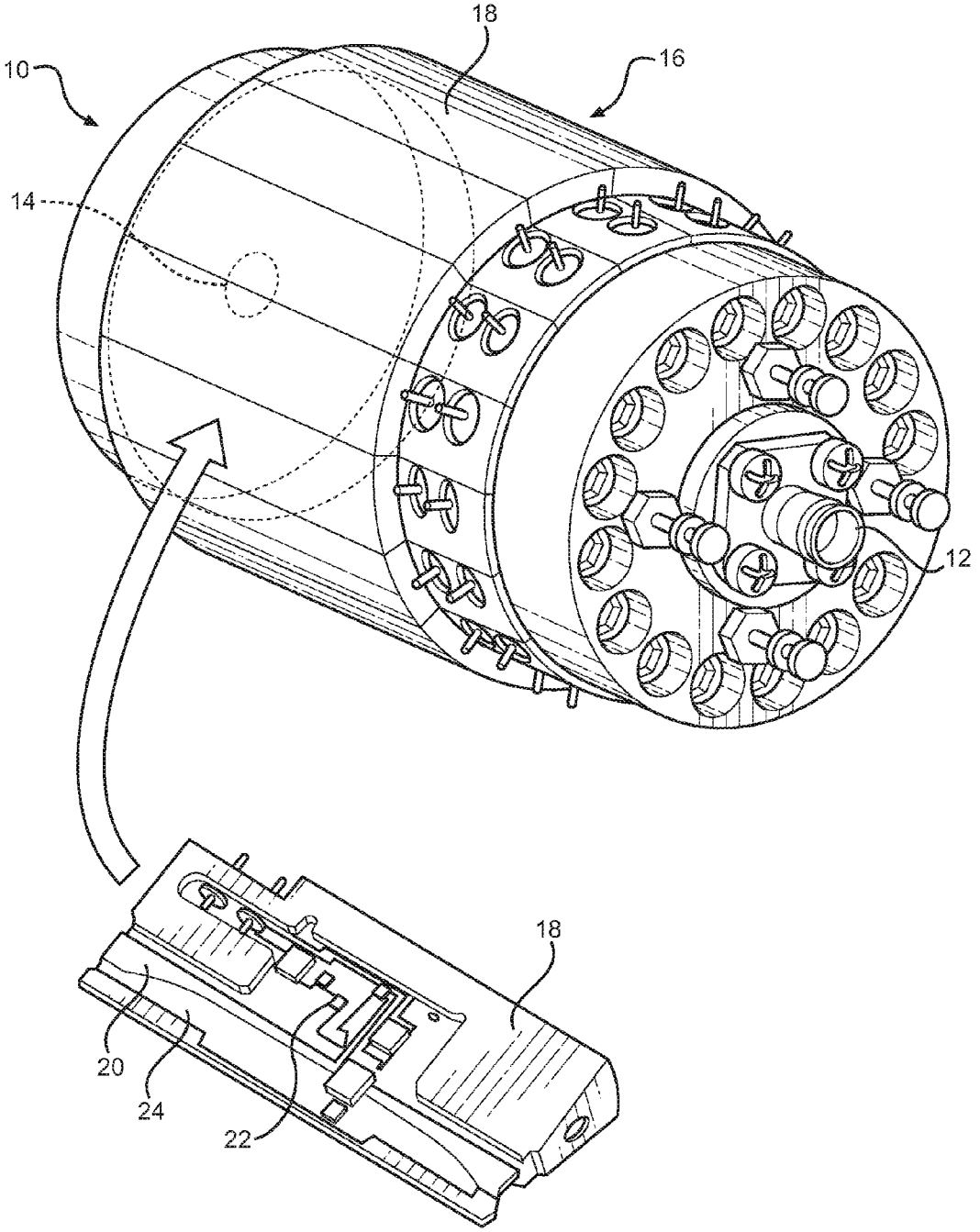
FIG. 1 Prior Art
FIG. 1 illustrates a conventional spatium amplifier according to the prior art.
Figure 9:
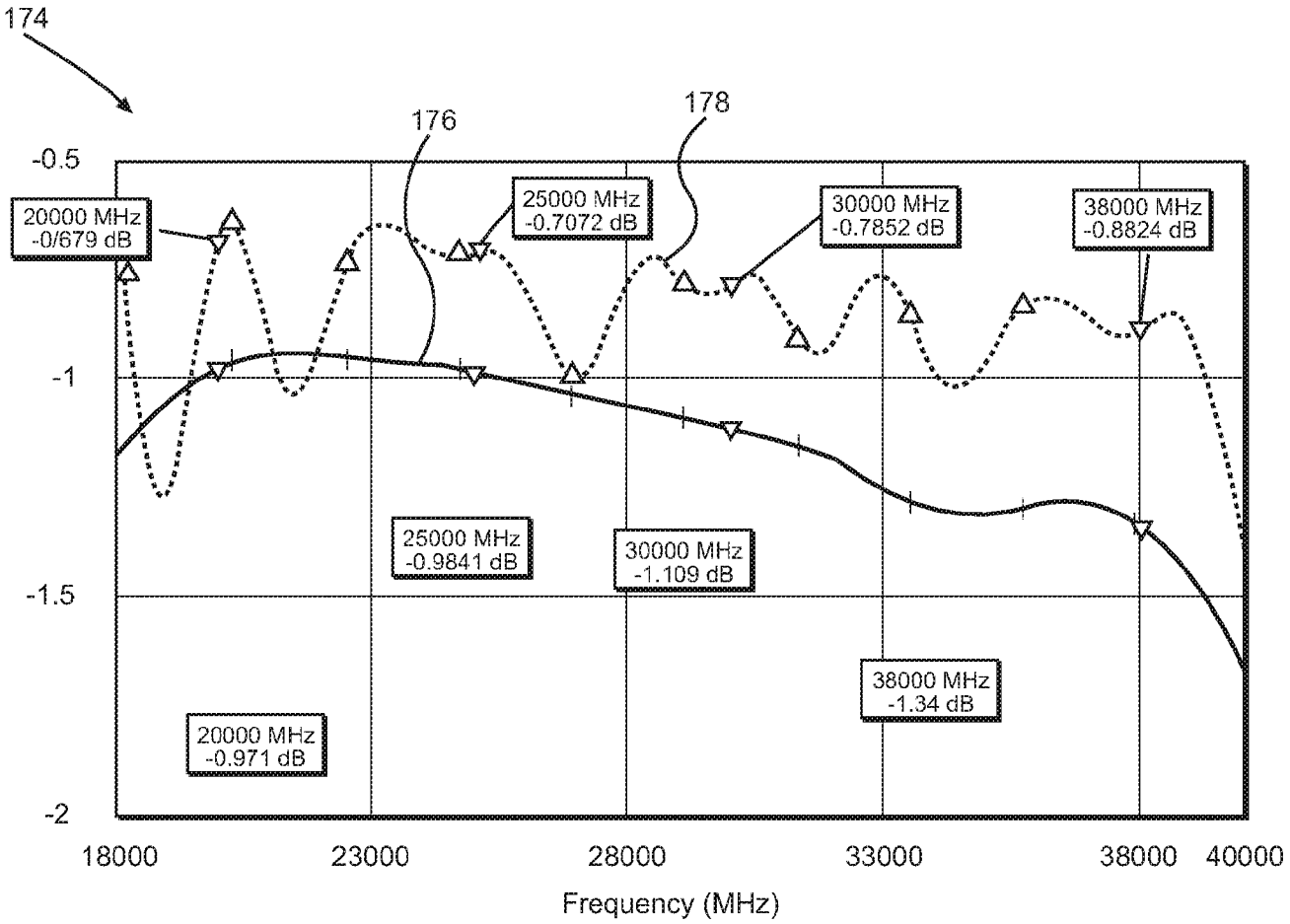
FIG. 9 is a graph comparing passive performance of the spatium amplifier assembly of FIG. 2 with passive performance of the conventional spatium amplifier of FIG. 1, according to an embodiment.

FIG. 9 is a graph 174 comparing passive performance of the spatium amplifier assembly 100 of FIGS. 2-8 with passive performance of the conventional spatium amplifier 10 of FIG. 1. Comparing a plot 176 of the frequency response of the spatium amplifier assembly 100 with insertion loss to a plot 178 of the frequency response of the conventional spatium amplifier 10 with insertion loss at the same frequencies, it can be seen that the performance of the spatium amplifier assembly 100 is significantly improved at higher frequencies over the conventional spatium amplifier 10.

Figure 10:
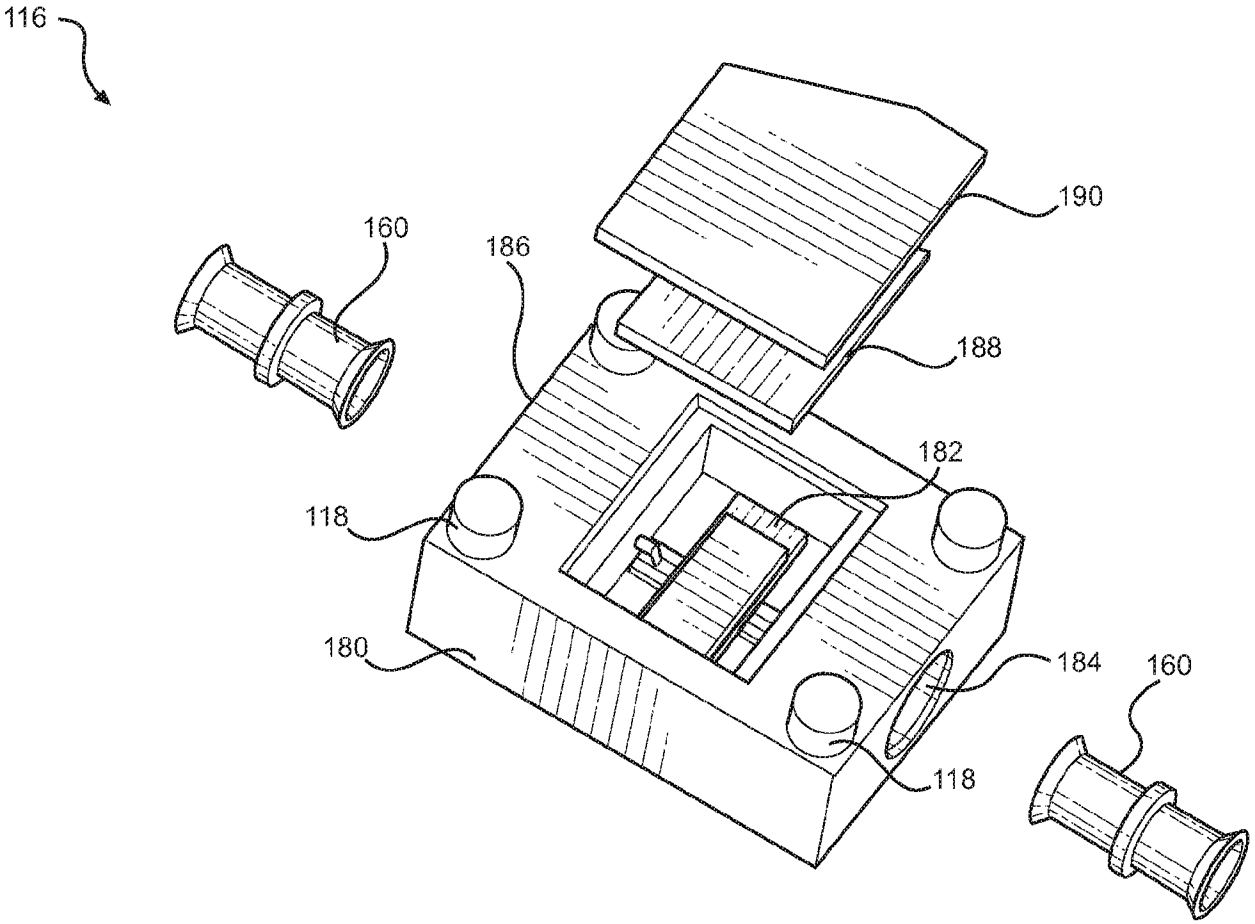
FIG. 10 illustrates a partially exploded isometric view of an amplifier, illustrating assembly of the amplifier, according to an embodiment.

FIG. 10 illustrates an isometric view of an amplifier 116 according to an embodiment. In this embodiment, each amplifier 116 an aluminum housing 180 containing a monolithic microwave integrated circuit (MMIC) 182 for amplifying a split RF input signal received at an input 184 of the MMIC 182 and outputting an amplified split RF output signal at an output 186 of the MMIC 182. In this embodiment, the coaxial interconnects 160 are blind mate-style connectors that are electromagnetically coupled to the input 184 and output 186 of the MMIC 182. In this embodiment, the housing 180 may also accommodate an alumina substrate and/or single layer capacitors (SLCs), as is known in the art. The amplifier 116 also includes an inner cover 188 for the MMIC 182 and an outer cover 190 that covers the inner cover 188. The inner cover 188 and/or outer cover 190 may be permanently attached to the housing 180, such as by laser welding for example, to hermetically seal the housing 180 and produce a modular amplifier 116 that can easily be replaced in a spatium amplifier assembly 100.

FIG. 11 illustrates an alternative heat sink 192 having a substantially annular profile, which may allow for a more compact package for the spatium amplifier assembly 100. In this and the above embodiments, the amplifiers 116 are oriented inwardly for conduction cooling, using a liquid coolant, for example. In the embodiment of FIG. 12, an alternative heat sink 194 is substantially disc-shaped, so that the amplifiers 116 are arranged around the heat sink 194 in an outward facing configuration, for convection cooling.

Those skilled in the art will recognize improvements and modifications to the preferred embodiments of the present disclosure. All such improvements and modifications are considered within the scope of the concepts disclosed herein and the claims that follow.

What is claimed is:

1. An antenna assembly for a spatial coupler, the antenna assembly comprising:

a core member comprising:

a cylindrical core portion extending longitudinally between a first end and a second end of the antenna assembly, the cylindrical core portion defining an outer core diameter; and a plurality of core fins extending radially outwardly from the cylindrical core portion, each of the plurality of core fins tapering from a first height at the first end of the antenna assembly to a second height smaller than the first height at the second end of the antenna assembly; and a shell member disposed around the core member, the shell member comprising:

a cylindrical shell portion extending longitudinally between the first end and the second end of the antenna assembly, the cylindrical shell portion defining an inner shell diameter; and a plurality of shell fins corresponding to the plurality of core fins to form a plurality of fin pairs, the plurality of shell fins extending radially inwardly from the cylindrical shell portion, each of the plurality of shell fins tapering from a third height at the first end of the antenna assembly to a fourth height smaller than the third height at the second end of the antenna assembly, wherein each fin pair of the plurality of fin pairs forms a tapering channel therebetween, the tapering channel having a first channel height at the second end of the antenna assembly and a second channel height at the first end of the antenna assembly, the second channel height smaller than the first channel height.

2. The antenna assembly of claim 1, wherein each fin pair forms a channel with each adjacent fin pair, each channel having a channel height equal to the inner shell diameter minus the outer core diameter.

3. The antenna assembly of claim 2, wherein the plurality of fin pairs are a plurality of waveguides configured to:

receive a combined electromagnetic signal at the second end of the antenna assembly;

guide the combined electromagnetic signal toward the first end of the antenna assembly;

split the combined electromagnetic signal into first plurality of split electromagnetic signals corresponding to a respective waveguide; and output each split electromagnetic signal from the respective waveguide at the first end of the antenna assembly.

4. The antenna assembly of claim 3, wherein the plurality of waveguides is further configured to:

receive a respective plurality of split electrometric signals at the first end of the antenna assembly;

guide the plurality of split electromagnetic signals toward the second end of the antenna assembly;

combine the plurality of split electromagnetic signals into the combined electromagnetic signal; and output the combined electromagnetic signal at the second end of the antenna assembly.

5. The antenna assembly of claim 2, wherein the plurality of fin pairs is a plurality of waveguides configured to:

receive a respective plurality of split electrometric signals at the first end of the antenna assembly;

guide the plurality of split electromagnetic signals toward the second end of the antenna assembly;

combine the plurality of split electromagnetic signals into a combined electromagnetic signal; and output the combined electromagnetic signal at the second end of the antenna assembly.

6. The antenna assembly of claim 1, further comprising a plurality of waveguide interfaces disposed at the first end of the antenna assembly, each of the plurality of waveguide interfaces configured to pass a split electromagnetic signal between a respective pair of fins at the first end of the antenna assembly and a respective interconnect.

7. The antenna assembly of claim 1, further comprising a coaxial interface disposed at the second end of the antenna assembly, the coaxial interface configured to pass a combined electromagnetic signal between the second end of the antenna assembly and a first coaxial interconnect.

8. The antenna assembly of claim 7, further comprising a plurality of waveguide interfaces disposed at the first end of the antenna assembly, each of the plurality of waveguide interfaces configured to pass a split electromagnetic signal between a respective pair of fins at the first end of the antenna assembly and a respective second interconnect.

9. The antenna assembly of claim 8, wherein the plurality of waveguide interfaces extend radially away from the antenna assembly.

10. The antenna assembly of claim 8, wherein each respective second interconnect is configured to be connected to at least one of a group consisting of: an amplifier input and an amplifier output.

11. A spatial coupler assembly comprising:

an antenna sub-assembly comprising:

a core member comprising:

a cylindrical core portion extending longitudinally between a first end and a second end of the antenna sub-assembly, the cylindrical core portion defining an outer core diameter; and a plurality of core fins extending radially outwardly from the cylindrical core portion, each of the plurality of core fins tapering from a first height at the first end of the antenna sub-assembly to a second height smaller than the first height at the second end of the antenna sub-assembly; and a shell member disposed around the core member, the shell member comprising:

a cylindrical shell portion extending longitudinally between the first end and the second end of the antenna sub-assembly, the cylindrical shell portion defining an inner shell diameter; and a plurality of shell fins corresponding to the plurality of core fins to form a plurality of fin pairs, the plurality of shell fins extending radially inwardly from the cylindrical shell portion, each of the plurality of shell fins tapering from a third height at the first end of the antenna sub-assembly to a fourth height smaller than the third height at the second end of the antenna sub-assembly, wherein each fin pair of the plurality of fin pairs forms a tapering channel therebetween, the tapering channel having a first channel height at the second end of the antenna sub-assembly and a second channel height at the first end of the antenna sub-assembly, the second channel height smaller than the first channel height; and a plurality of amplifiers, each electromagnetically coupled to a respective fin pair at the first end of the antenna sub-assembly.

12. The spatial coupler assembly of claim 11, further comprising a plurality of waveguide interfaces electromagnetically coupling the respective plurality of amplifiers to the plurality of fin pairs.

13. The spatial coupler assembly of claim 11, wherein the antenna sub-assembly is a plurality of antenna sub-assemblies comprising a splitter antenna sub-assembly and a combiner antenna sub-assembly, wherein each of the plurality of amplifiers comprises an amplifier input and an amplifier output, wherein each fin pair of the splitter antenna sub-assembly is electromagnetically coupled to a respective amplifier input, and wherein each fin pair of the combiner antenna sub-assembly is electromagnetically coupled to a respective amplifier output.

14. The spatial coupler assembly of claim 13, wherein the splitter antenna sub-assembly further comprises a splitter coaxial interface electromagnetically coupled to the second end of the splitter antenna sub-assembly, and wherein the combiner antenna sub-assembly further comprises a combiner coaxial interface electromagnetically coupled to the second end of the combiner antenna sub-assembly.

15. The spatial coupler assembly of claim 13, wherein the splitter antenna sub-assembly is further configured to:

receive a first combined electromagnetic signal at the second end of the splitter antenna sub-assembly;

guide the first combined electromagnetic signal toward the first end of the splitter antenna sub-assembly;

split the first combined electromagnetic signal into a plurality of first split electromagnetic signals corresponding to a respective waveguide; and output each first split electromagnetic signal from the respective waveguide at the first end of the antenna sub-assembly to the respective amplifier input, wherein the plurality of amplifiers is further configured to:

amplify the respective first split electromagnetic signals received at the respective amplifier inputs into a plurality of respective second split electromagnetic signals, and output the second split electromagnetic signals at the respective plurality of amplifier outputs; and wherein the combiner antenna sub-assembly is further configured to:

receive the plurality of respective second split electrometric signals from the respective plurality of amplifier outputs at the respective plurality of fin pairs at the first end of the combiner antenna sub-assembly;

guide the plurality of second split electromagnetic signals toward the second end of the antenna sub-assembly;

combine the plurality of second split electromagnetic signals into a second combined electromagnetic signal; and output the second combined electromagnetic signal at the second end of the antenna sub-assembly.

16. A method of assembling a spatial coupler, the method comprising:

disposing a shell member around a core member to form an antenna sub-assembly having a first end and a second end, wherein a plurality of shell fins extend radially inwardly from a cylindrical shell portion of the shell member and a plurality of core fins corresponding to the plurality of shell fins extend radially outwardly from a cylindrical core portion of the core member; and aligning the plurality of shell fins with the plurality of core fins to form a plurality of fin pairs, each fin pair forming a tapering channel therebetween, wherein each tapering channel tapers from a first width at the second end of the antenna sub-assembly to a second width smaller than the first width at the first end of the antenna sub-assembly.

17. The method of claim 16, further comprising electromagnetically coupling a plurality of amplifiers to the first end of the antenna sub-assembly.

18. The method of claim 17, wherein the second end of the antenna sub-assembly comprises a coaxial interface.

19. The method of claim 16, wherein the antenna sub-assembly comprises a first antenna sub-assembly and a second antenna sub-assembly, the method further comprising:

electromagnetically coupling a plurality of amplifiers between the first end of the antenna sub-assembly and the first end of the second antenna sub-assembly, wherein each amplifier comprises an input electromagnetically coupled to the first end the first antenna sub-assembly and an output electromagnetically coupled the first end of the second antenna sub-assembly.

20. The method of claim 19, wherein the second end of the first antenna sub-assembly comprises a coaxial input, and the second end of the second antenna sub-assembly comprises a coaxial output.

* * * * *